US007710044B2

(12) United States Patent
Simonsen et al.

(10) Patent No.: US 7,710,044 B2
(45) Date of Patent: May 4, 2010

(54) FLASHLAMP DRIVE CIRCUIT

(75) Inventors: Jan Simonsen, Struer (DK); Michael Noel Kiernan, Swansea (GB)

(73) Assignee: Cyden Limited, Swansea (GB)

( * ) Notice: Subject to any disclaimer, the term of this patent is extended or adjusted under 35 U.S.C. 154(b) by 555 days.

(21) Appl. No.: 11/628,417

(22) PCT Filed: May 20, 2005

(86) PCT No.: PCT/GB2005/001977

§ 371 (c)(1),
(2), (4) Date: Dec. 4, 2006

(87) PCT Pub. No.: WO2005/120137

PCT Pub. Date: Dec. 15, 2005

(65) Prior Publication Data

US 2008/0067946 A1 Mar. 20, 2008

(30) Foreign Application Priority Data

Jun. 3, 2004 (GB) ..... 0412352.7

(51) Int. Cl.
*H05B 37/02* (2006.01)

(52) U.S. Cl. ..... 315/241 S; 315/200 A; 606/2; 606/9; 607/88

(58) Field of Classification Search ..... 315/241 S, 315/241 P, 200 A, 201, 228–232, 294, 312; 340/468, 471, 472, 331; 606/2, 3, 9, 10–12; 607/88–92

See application file for complete search history.

(56) References Cited

U.S. PATENT DOCUMENTS 5,886,620 A * 3/1999 Stewart et al. ..... 315/241 S
5,982,275 A * 11/1999 Kosich ..... 315/200 A
6,373,197 B1 * 4/2002 Chang ..... 315/241 S

* cited by examiner

*Primary Examiner*—Douglas W Owens
*Assistant Examiner*—Ephrem Alemu
(74) *Attorney, Agent, or Firm*—Kohn & Associates, PLLC

(57) ABSTRACT

A flashlamp drive circuit including a storage capacitor which is charged and selectively discharged in order to drive a flashlamp. A capacitor (116) is connected in parallel with each respective flashlamp (106) in a bank of flashlamps. Each capacitor (116) has a comparatively small capacitance so as to be capable of storing only a portion of the total energy pulse required to be delivered to the respective flashlamp (106). A controller, comprising a digital signal processor (118) and a microprocessor (120) is provided to control the operation of all of the flashlamps (106) in the bank via respective switch mechanisms (110). In use, each energy (or drive) pulse delivered to a flashlamp (106) is comprised of a plurality of smaller energy packets resulting from repeated charging and discharging of the respective capacitor (116). Thus, the shape and duration of the current pulses delivered to the flashlamp (106) is highly controllable and the size of the storage capacitor (116) required is significantly reduced relative to the prior art.

3 Claims, 5 Drawing Sheets

FLASHLAMP DRIVE CIRCUIT

CROSS-REFERENCE TO RELATED APPLICATIONS

This is a National Phase filing Under 35 U.S.C. 371 of International Application No. PCT/GB05/001977, filed May 20, 2005, which claims the benefit of priority of Great Britain Patent Application Serial No. 0412352.7, filed Jun. 3, 2004, both of which are incorporated herein by reference.

TECHNICAL FIELD

This invention relates generally to a drive circuit for a pulsed radiation source and, more particularly (but not necessarily exclusively), to a flashlamp drive circuit including a storage capacitor which is selectively discharged in order to drive a flashlamp.

BACKGROUND OF THE INVENTION

Pulsed flashlamps are used in a variety of applications, including optical cosmetology and dermatology applications. Such lamps normally operate at a comparatively high peak voltage, current and light intensity/power. In order to achieve such high values, power supplies or drives for such lamps typically employ a storage capacitor, which is charged between flashes or pulses, in series with an inductor and some kind of switch.

Thus, referring to FIG. 1A of the drawings, there is illustrated a simplified version of a conventional flashlamp drive circuit, in which a power supply unit 100 is used to charge a relatively small capacitor 102, in this case say 500 μF. A switch 104 is provided between the capacitor 102 and the flashlamp 106. Examples of switches used in the past have included thyristors, which once turned on, generally remain on until the capacitor has fully discharged, and transistors. When the switch 104 is closed, the capacitor 102 is substantially completely discharged to the flashlamp 106, giving a drive current pulse similar to that illustrated in FIG. 1B, whereby around (say) 150J of energy (defined by the area under the curve in FIG. 1B) is delivered to the flashlamp in around 5 ms.

However, there are applications, particularly medical applications, where the shape of the optical pulses used to drive the flashlamp is important in order to achieve the desired therapeutic effect, and in particular to achieve such effect without damage to areas of the patient's body not being treated. For example, in optical dermatology, it may be desirable to rapidly heat a target chromophore to a selected temperature, and to then reduce applied energy so as to maintain the chromophore at the desired temperature. It is therefore highly desirable for the shape and duration of the optical pulses delivered to the flashlamp to be controllable.

Referring to FIG. 2A of the drawings, there is illustrated a simplified form of another known flashlamp drive circuit, in which a power supply unit 100 is used to charge a relatively large capacitor 102 (say, 0.2 F) up to, say 1500 J, and a switch 104 (embodied in this case by a transistor) is used to deliver a small portion of this total energy (say 150 J) at a time. In view of the manner of operation of this type of partial discharge system, an optical pulse can be delivered to the flashlamp 106 with a relatively uniform energy distribution, as illustrated in FIG. 2B of the drawings. Effectively, a drive system of the type illustrated in FIG. 2A of the drawings, delivers a plurality of small packets 108 of energy. Thus, in the case where 150 J of energy are delivered in a 50 ms time interval, each packet

108 will consist of 0.03 J/μs. As a result, it is possible, using such a system, to control the shape of the optical pulse delivered to the flashlamp in order to achieve the desired effect.

However, a major disadvantage of the partial discharge system described with reference to FIG. 2A of the drawings, is the size of the capacitor 102, whereas it is highly desirable in all flashlamp applications to minimise the size of the capacitor (and therefore the charge it carries) as this has the effect of minimising the size, weight and cost of the lamp drive circuitry and enhances the safety of such drive circuits by reducing shock risks.

It is an object of the present invention to provide flashlamp drive circuitry, and a corresponding method of driving a flashlamp, whereby the shape and duration of the current pulses delivered to the flashlamp is highly controllable, and the size of the storage capacitor required is significantly reduced relative to known arrangements.

SUMMARY OF THE INVENTION

In accordance with the present invention, there is provided a pulsed radiation source drive circuit for delivering an energy pulse to a radiation source, said circuit comprising a storage capacitor having a comparatively small capacitance so as to be capable of storing only a portion of the total energy of the energy pulse required to be delivered to said radiation source, said circuit further comprising means for selectively charging and discharging said storage capacitor at a comparatively high frequency so as to deliver to said radiation source said energy pulse in the form of a plurality of packets of energy within a predetermined time period.

Thus, the present invention is intended to provide a drive circuit, preferably for a flashlamp, which drive circuit effectively mimics the operation of the partial discharge system described above with reference to FIG. 2A of the drawings, using a relatively very small capacitor by providing means for performing relatively high frequency charging and discharging of the capacitor, i.e. the capacitor output is modulated at a high frequency to achieve the desired energy pulse.

Also in accordance with the present invention, there is provided a method of driving a pulsed radiation source, the method comprising providing a storage capacitor having a comparatively small capacitance so as to be capable of storing only a portion of the total energy of an energy pulse required to be delivered to said radiation source, and selectively charging and discharging said storage capacitor at a comparatively high frequency so as to deliver to said radiation source said energy pulse in the form of a plurality of packets of energy within a predetermined time period.

The present invention extends to a flashlamp unit comprising a flashlamp and including a drive circuit as defined above for driving said flashlamp.

The present invention extends still further to a digital signal processor for use in a drive circuit as defined above, the digital signal processor being arranged and configured to control the operation of switch means so as to selectively charge and discharge said storage capacitor at a comparatively high frequency so as to deliver to said radiation source an energy pulse in the form of a plurality of packets of energy within a predetermined time period.

Preferably, the pulsed radiation source comprises a flashlamp.

Beneficially, the means for selectively charging and discharging the capacitor comprises switch means, and drive means for selectively opening and closing said switch. The switch may, for example, comprise an insulated-gate transistor, such as an insulated-gate bipolar transistor (IGBT).

In a preferred embodiment, the storage capacitor is connected in parallel with the pulsed radiation source.

A flashlamp unit according to the invention may comprise a plurality of flashlamps, each having associated therewith a respective storage capacitor and respective means for selectively charging and discharging said storage capacitor. Means, such as a digital signal processor and microprocessor, are beneficially provided for controlling the plurality of means for selectively charging and discharging the respective storage capacitors.

These and other aspects of the present invention will be apparent from, and elucidated with reference to the embodiment described herein.

BRIEF DESCRIPTION OF THE DRAWINGS

An embodiment of the present invention will now be described by way of example only and with reference to the accompanying drawings, in which.

DETAILED DESCRIPTION OF THE INVENTION

Figure 1A:
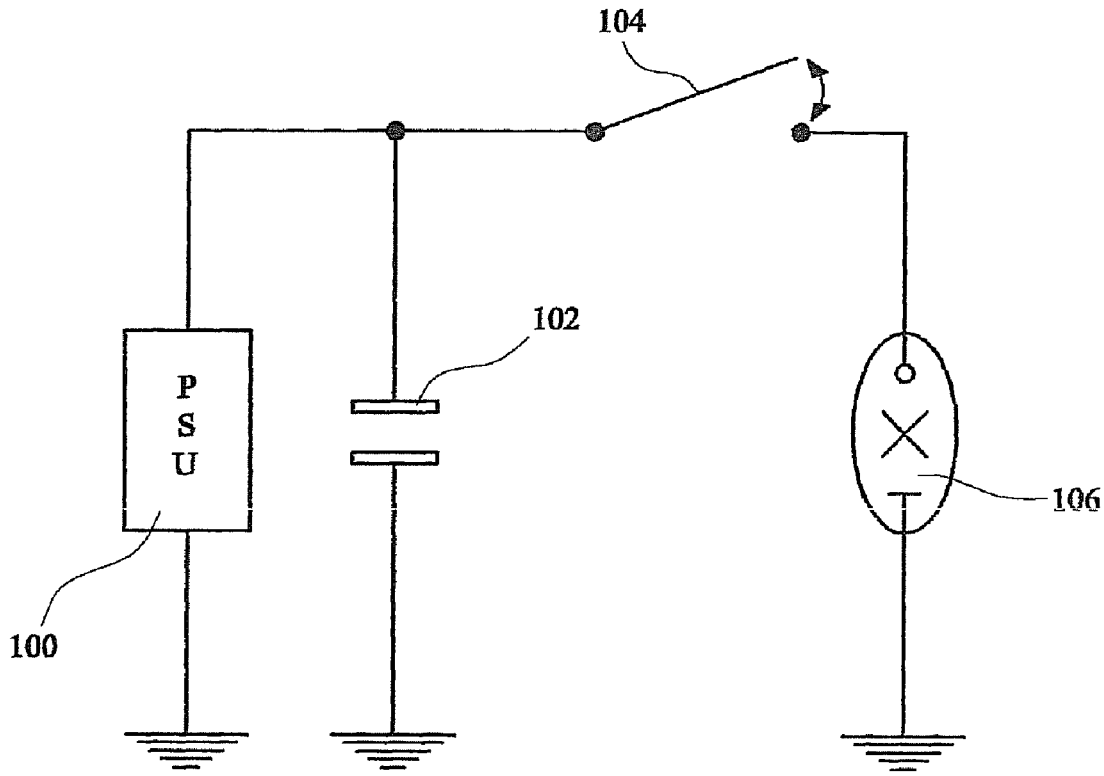
FIG. 1A PRIOR ART
FIG. 1A is a simplified circuit diagram of a first flashlamp drive circuit and flashlamp configuration according to the prior art.
Figure 1B:
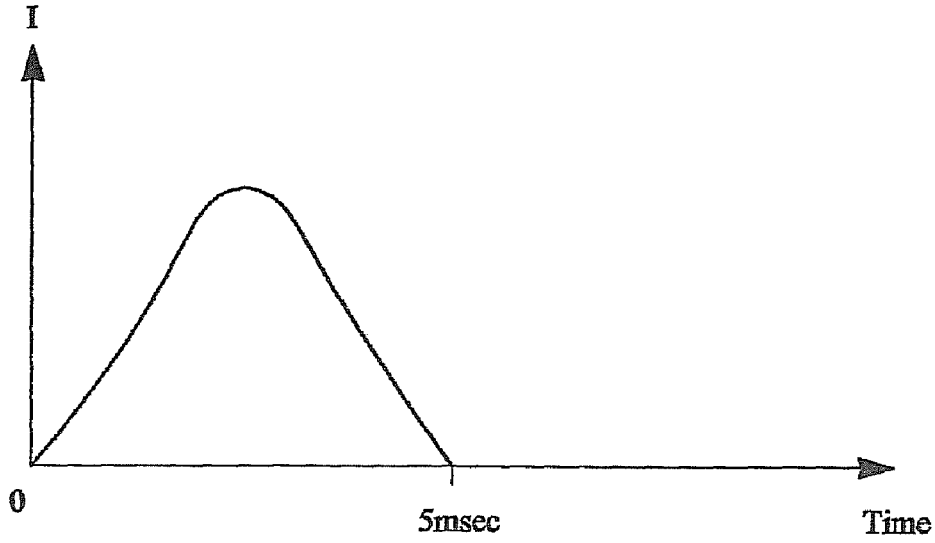
FIG. 1B PRIOR ART
FIG. 1B illustrates an energy pulse which can be delivered by the circuit of FIG. 1A.
Figure 2A:
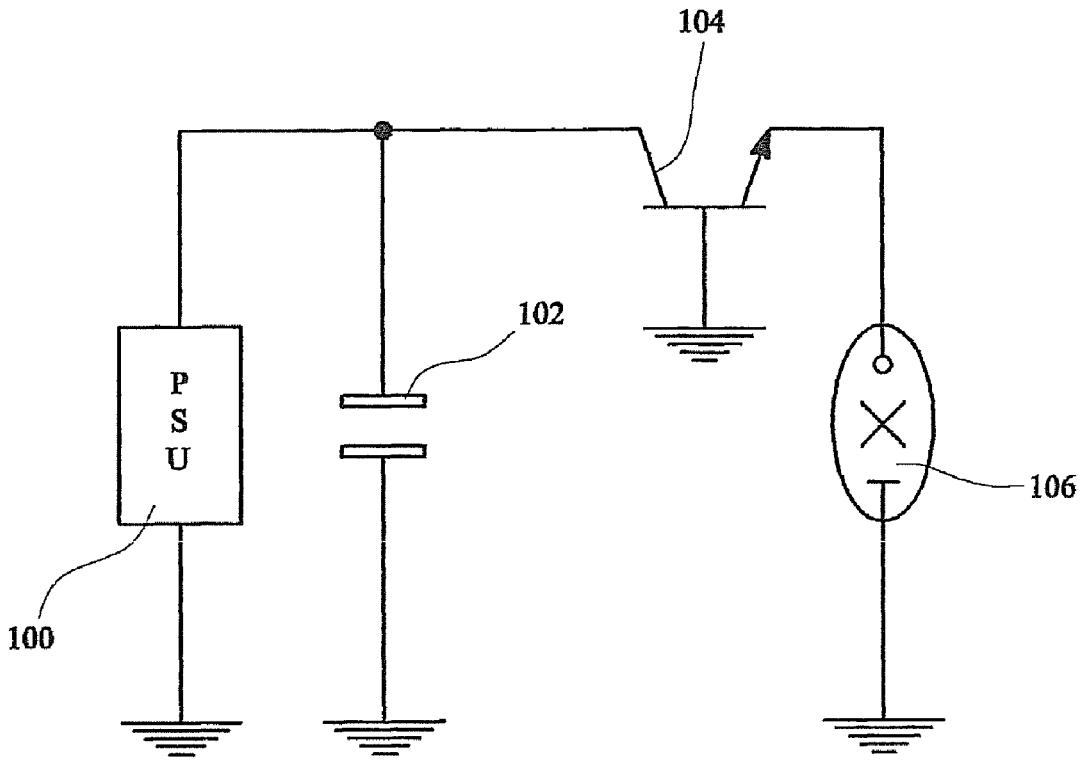
FIG. 2A PRIOR ART
FIG. 2A is a simplified circuit diagram of a second flashlamp drive circuit and flashlamp configuration according to the prior art.
Figure 2B:
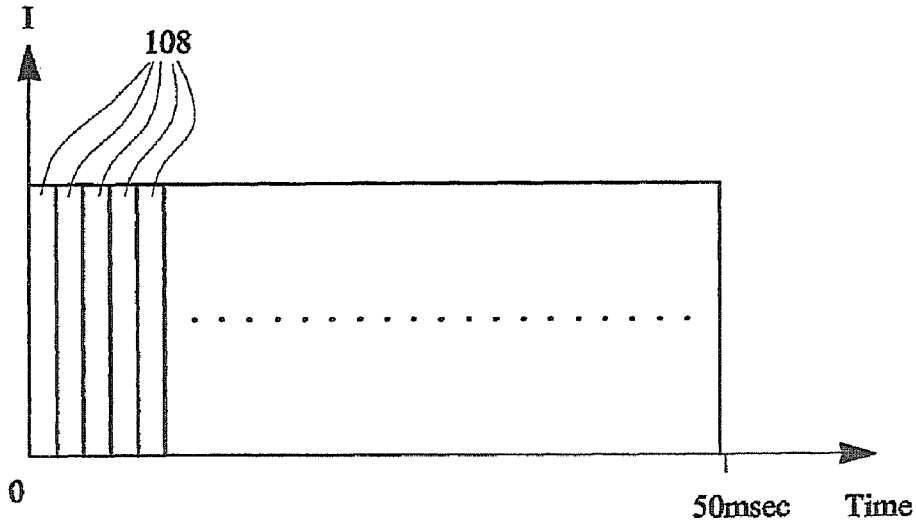
FIG. 2B PRIOR ART
FIG. 2B illustrates an energy pulse which can be delivered by the circuit of FIG. 2A.
Figure 3:
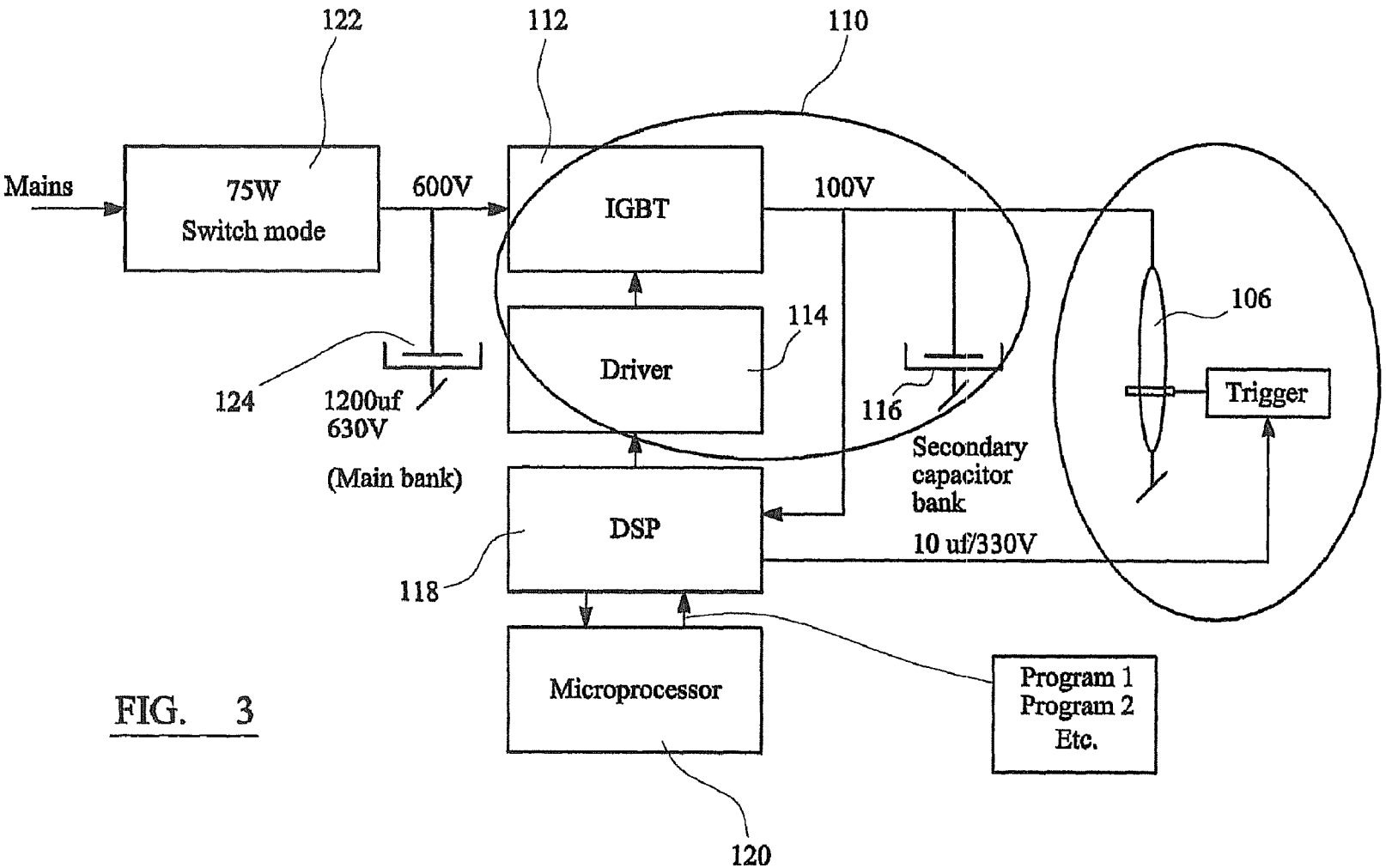
FIG. 3 is a schematic circuit diagram illustrating a flashlamp drive circuit and flashlamp configuration according to an exemplary embodiment of the present invention.
Figure 4:
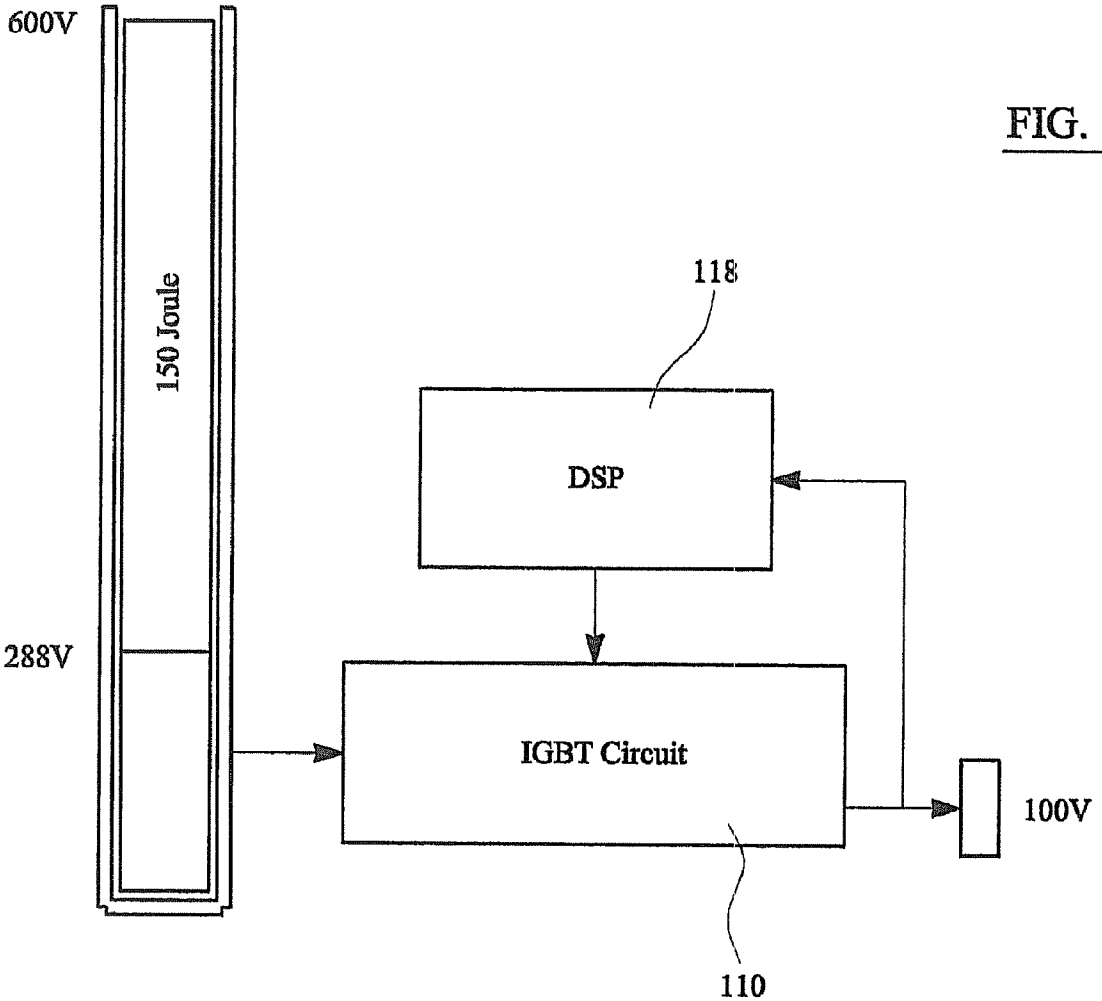
FIG. 4 illustrates schematically a portion of the circuit of FIG. 3.

Referring to FIGS. 3 and 4 of the drawings, there is illustrated a flashlamp unit including a drive circuit according to an exemplary embodiment of the present invention. The flashlamp 106 may, for example, comprise a delivery head carrying light emitting apparatus in the form of an electric discharge tube containing a high pressure Noble/inert gas such as Xenon or Krypton. The discharge tube operates to produce, in response to the input of a current pulse, a burst of light of a range of wavelengths in the visible spectrum (approximately in the range 400 to 700 nm). However, many different types of flashlamps and other pulsed radiation sources will be well known to a person skilled in the art, and their specific form and structure will not be described in any further detail herein. A bank of, say, six flashlamps or other pulsed radiation sources may be provided in a single unit, as required by the particular application.

Associated with the or each flashlamp 106, there is provided a switch mechanism 110 comprised of an insulated-gate bipolar transistor (IGBT) 112 and a corresponding driver 114. The switch mechanism 110 also incorporates a secondary transistor 116, having a comparatively very small capacitance of (say) 10 μF. The capacitor 116 and the respective flashlamp 106 are connected in parallel with each other. A controller, comprising a digital signal processor (DSP) 118 and a microprocessor 120, is provided to control the operation of all of the flashlamps 106 in the bank via the respective switch mechanisms 110. It will be appreciated that the microprocessor can be programmed so as to cause the digital signal processor to run the bank of flashlamps in accordance with any one of a number of different programs, depending on the application.

A switch mode power supply 122 and a primary capacitor 124 are also provided.

Figure 5:
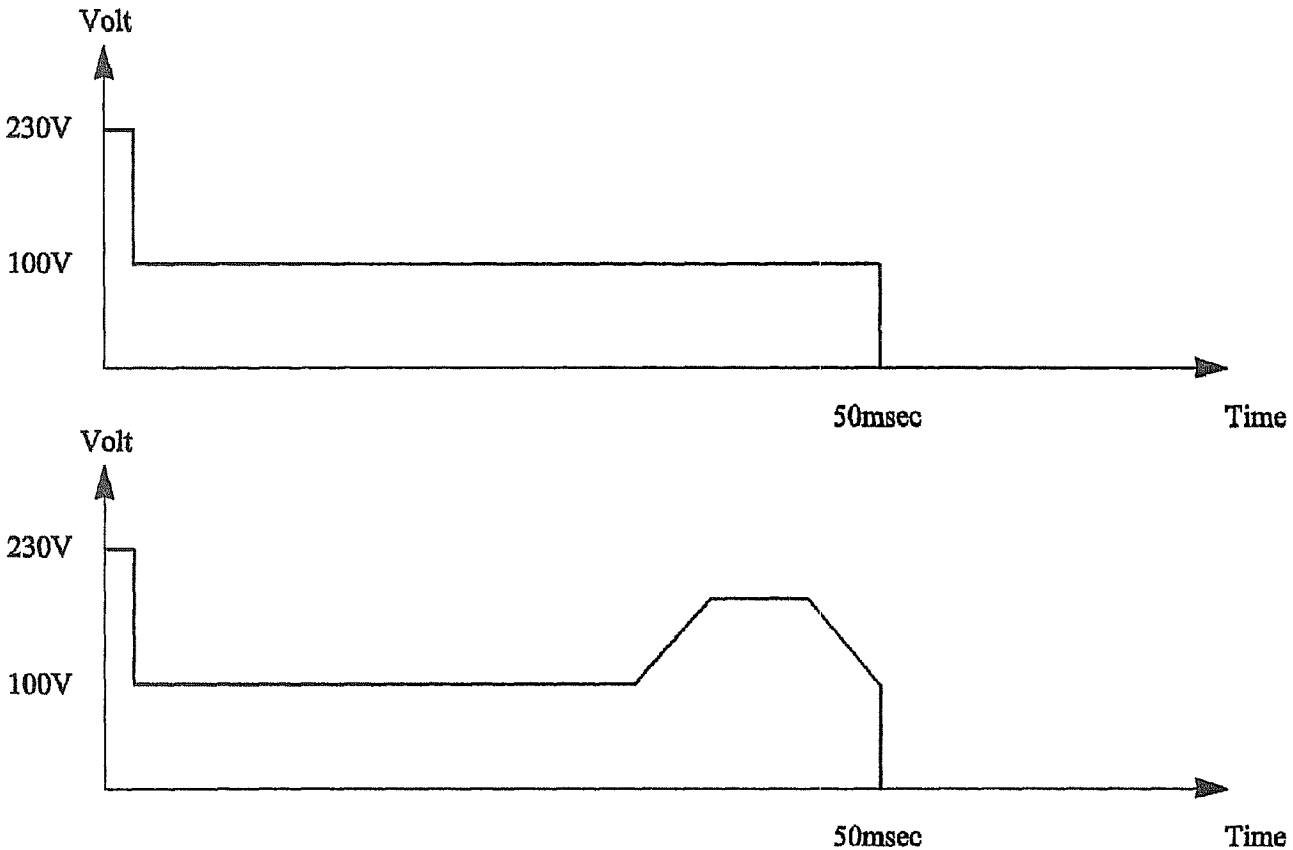
FIGS. 5A and 5B illustrate energy pulse forms which can be delivered by the circuit of FIG. 3.

In use, each drive pulse delivered to a flashlamp 106 is comprised of a plurality of smaller energy packets resulting from the high frequency, repeated charging and discharging of the respective capacitor 116, controlled by the DSP 118 via the respective driver 114. As a result, there is provided flashlamp drive circuitry, and a corresponding method of driving a flashlamp, whereby the shape and duration of the current pulses delivered to the flashlamp is highly controllable, and the size of the storage capacitor required is significantly reduced relative to known arrangements. Examples of the types of energy pulses which can be delivered using the drive circuit described above with reference to FIGS. 3 and 4 of the drawings, are illustrated in FIG. 5 of the drawings.

It should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The word "comprising" and "comprises", and the like, does not exclude the presence of elements or steps other than those listed in any claim or the specification as a whole. The singular reference of an element does not exclude the plural reference of such elements and vice-versa. The invention may be implemented by means of hardware comprising several distinct elements, and by means of a suitably programmed computer. In a device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method of generating from at least one flashlamp a series of optical output pulses of a range of wavelengths in the visible spectrum for cosmetological or dermatological purposes, each said optical pulse having a predetermined time interval, which method comprises the following steps:

(i) providing said at least one flashlamp with a drive circuit comprising a storage capacitor, switch means comprising an insulated gate transistor, a driver for opening and closing said switch means, and a digital signal processor operatively connected to said driver;

(ii) operating said driver under the influence of said digital signal processor so as to selectively open and close said switch means and thereby to respectively selectively and repeatedly charge said storage capacitor and discharge said storage capacitor; and (iii) controlling said discharge of said capacitor so as to deliver to each said flashlamp a plurality of packets of electrical energy each of duration less than, and of high frequency relative to, said predetermined time interval.

2. A method according to claim 1, wherein said storage capacitor means is connected in parallel with the electric discharge lamp.

3. A method according to claim 1, wherein said flashlamp comprises a xenon discharge tube.

* * * * *